US007055482B1

(12) United States Patent
Jefferson

(10) Patent No.: US 7,055,482 B1
(45) Date of Patent: Jun. 6, 2006

(54) COVER FOR SPARK PLUG, IGNITION WIRE AND BOOT

(76) Inventor: Ernest T. Jefferson, P.O. Box 215, Belhaven, NC (US) 27810

( * ) Notice: Subject to any disclaimer, the term of this patent is extended or adjusted under 35 U.S.C. 154(b) by 309 days.

(21) Appl. No.: 10/962,229

(22) Filed: Oct. 12, 2004

Related U.S. Application Data

(63) Continuation-in-part of application No. 10/753,285, filed on Jan. 9, 2004, now Pat. No. 6,810,847.

(51) Int. Cl.
*F02P 1/00* (2006.01)

(52) U.S. Cl. ..... 123/169 P; 123/169 E

(58) Field of Classification Search ..... 123/169 PA, 123/636, 146.5 R, 169 E, 169 P; 439/125, 439/128
See application file for complete search history.

(56) References Cited

U.S. PATENT DOCUMENTS 6,386,893 B1 * 5/2002 Reum et al. ..... 439/125

* cited by examiner

*Primary Examiner*—Bibhu Mohanty
(74) *Attorney, Agent, or Firm*—Mills Law Firm PLLC

(57) ABSTRACT

A cover for the spark plug boot and an ignition wire connected with spark plug of an engine includes a woven fiberglass sheath surrounding the spark plug insulator and spark plug boot and having an entrance cuff formed with an inner end flap stitched to form a pocket for capturing the end strands of the sheath, forming a four plug end construction that maintains the circularity of the opening and reduces the harmonic vibration in the sheath during engine operation.

14 Claims, 5 Drawing Sheets

COVER FOR SPARK PLUG, IGNITION WIRE AND BOOT

RELATED APPLICATION

This application is a continuation-in-part application of U.S. Ser. No. 10/753,285 filed on Jan. 9, 2004 now U.S. Pat. No. 6,810,847 Ernest T. Jefferson and entitled "Charge Dissipative Cover for Spark Plug, Ignition Wire and Boot".

FIELD OF THE INVENTION

The present invention relates to ignition wire shielding and, in particular, covers for grounding spark plugs and ignition cable components.

BACKGROUND OF THE INVENTION

Ignition systems for automotive engines are conventionally provided with an elastomeric boot for covering and protecting the electrical connection between the ignition cable and the spark plug. As engine operating temperatures have increased over the years and as the cylinder heads were located closer to the exhaust manifolds, the temperatures to which the boot and spark plug are exposed have increased correspondingly. The high temperatures reduce the useful life of the boot elastomer, even when high temperature silicone products and protective lubricants are used. In addition, the high voltage ignition systems on current engines can create conditions exceeding the dielectric strength leading to external grounding that can cause further erosion of the boot as well as corrosion of the contact interfaces. It has further been determined that the ignition cables can create high potential gradients, with attendant high E-field intensities creating corona discharges that can further degrade the boots and contacts.

In an early approach, metal shields were used to surround the spark plug boot to shield against excessive heat as disclosed in U.S. Pat. No. 4,497,532 to Benzusko et al. and U.S. Pat. No. 4,671,586 to DeBolt. The shields, however, can provide an adverse grounding path when the dielectric strength is exceeded resulting in engine misfire and performance reduction. It has also been proposed to use high temperature ceramic sleeves to isolate the spark plug boot from high operating temperatures as disclosed in U.S. Pat. No. 6,305,954 to Aluise. The sleeves are rigid and difficult to mount on existing cables, and are limited to in-line boots, to the exclusion of commonplace inclined or right angle boot configurations. The ceramic material does not assist in dissipating electrical fields. It has also been proposed to reduce corona discharge by incorporating a conductive sleeve on the boot interior as disclosed in U.S. Pat. No. 5,716,223 to Phillips et al. All of the foregoing approaches are directed to original equipment limiting the ability to provide improved protection to existing as well as new engines.

It would accordingly be desirable to provide a universal design for ready integration with existing and new ignition cables to protect the boot and electrical connection from deterioration by increasing thermal and radiant insulation, and decreasing adverse electrical effects.

It would also be desirable to provide an improved cover for the cables and boots that increases resistance of the cover to operational and mechanical degradation

SUMMARY OF THE INVENTION

The present invention provides a flexible fabric cover for simple installation over the spark plug boot that is coated with a heat reflective electrical conductive base coat and a dielectric top coat to provide electric dissipation protection. The cover takes the form of currently available fiberglass sleeves having a restrictive mouth that fits over the spark-plug insulator and a sleeve body that covers the boot and connector area and extends therebeyond. The sleeve body has sufficient flexibility to accommodate in-line and angled boots. The base coat comprises a high temperature silicone resin containing electrically conductive aluminum flake that provides infrared reflectivity and a conductive exterior sheath with low break down voltage that dissipates static and corona charges to eliminate elastomer attack. The top coat includes a silicone resin containing a high temperature ceramic pigment effective for providing a dielectric outer coating and increasing thermal resistance. The top coat may include a color pigment for providing an appealing contrasting color to the basically gray/silver coloration of the standard sleeve material. The novel cover may be installed on existing high operating temperature engines to shield against electrical charges, extend life and function of the boot assembly, lower cable operating temperatures. The materials are porous and breathable to reduce heat buildup and reduce moisture retention, non-flammable and non-toxic, and not reactive with petroleum products. The flexible fabric construction allows the cover to be conveniently mounted in recessed plug ports.

In another aspect of the invention, it has been found that such covers, with or without the dissipative protection may be prone to operational degradation of the cover material, a glass woven material. In the basic design the upper end of the sleeve terminates with a reversely inwardly turned flap that is medially circumferentially stitched. Such construction under certain operating conditions can exhibit premature wear characteristics. For example, frequent removal of the boot and wire can fray the cut end of the flap resulting in extended unwoven ends. Under engine vibration, the ends tend to fracture resulting in debris that can affect ignition performance. Moreover, the ends may get reversed during installation, projecting outwardly of the sleeve and distracting from the aesthetic appearance. It has also been determined that the woven sleeve is subject to harmonic vibration during engine operation that can lead to glass strand fracture and an additional source of debris. Further, the end is subject to permanent distortion, assuming an ovate shape that reduces the thermal insulating characteristics In a further embodiment, the above limitations are overcome by forming an initial flap at the free end of the outer layer which inverted against the inner sleeve and stitched so as to capture the strand ends in a containment pocket. The capture of the end thereby avoids the adverse effects of the unraveling. Further, the increased mass at the free end of the cover has been found to decrease the harmonic vibrations thereby extending the material life. Moreover, the additional layers greatly reinforces that circularity of the opening, even after repeated removals, thereby maintaining the insulating properties of the cover design.

Accordingly, it is an object of the present invention to provide an improved cover for protecting spark plug boot assemblies against thermal and electrical degradation.

Another object is to provide a flexible thermal and electrically protective cover for surface mounted and recessed port spark plug boots and connectors.

A further object is to provide a spark plug boot cover that dissipates static and corona charges to reduce degradation and operational impairment of spark plug boots and cable connections.

A still further object is to provide a protective spark plug boot cover that has improved resistance to operational material degradation.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENT

Figure 1:
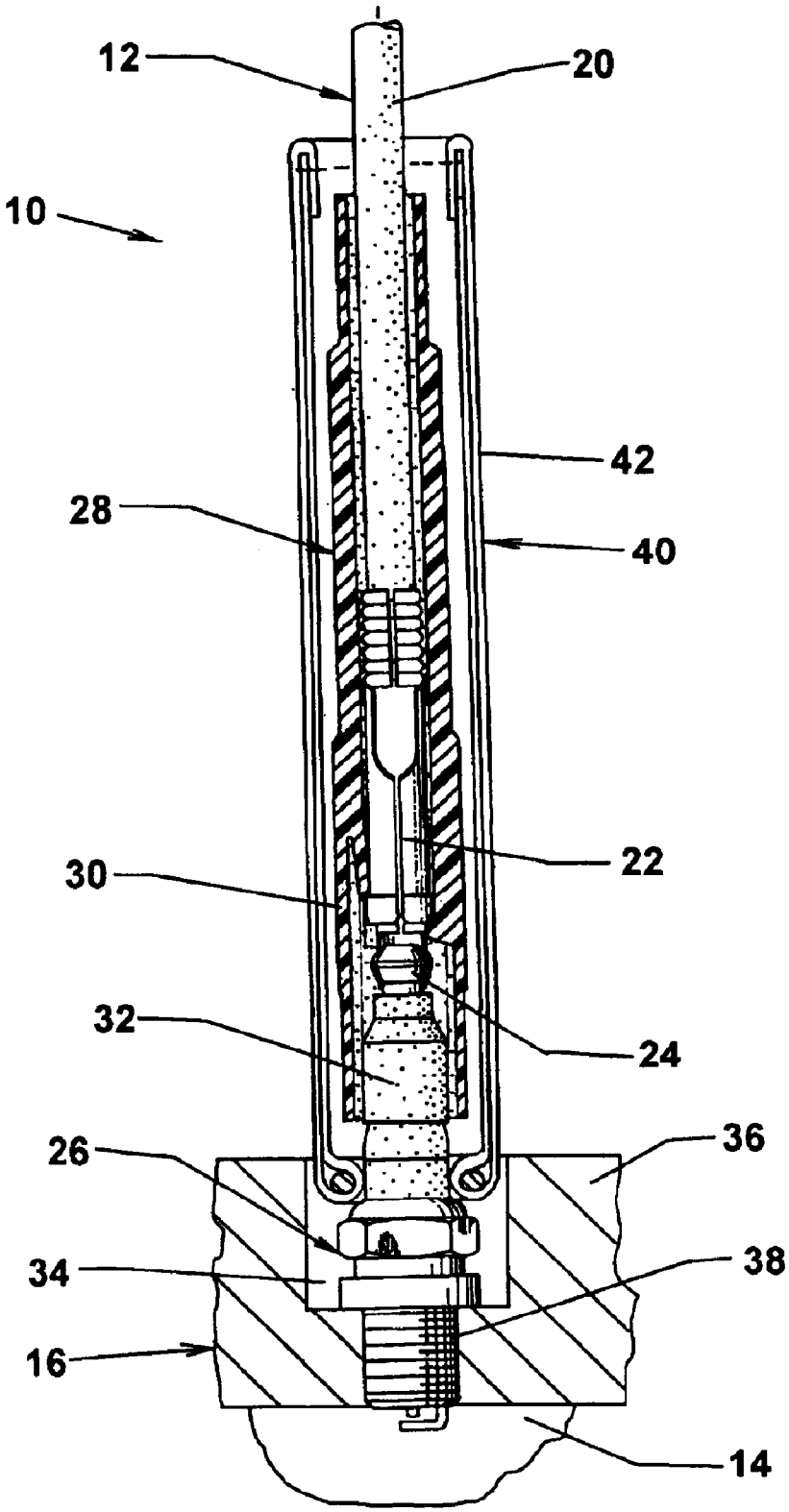
FIG. 1 is a side cross sectional view of a charge dissipative cover installed over an ignition line including an ignition cable, a spark plug boot and a spark plug.
Figure 2:
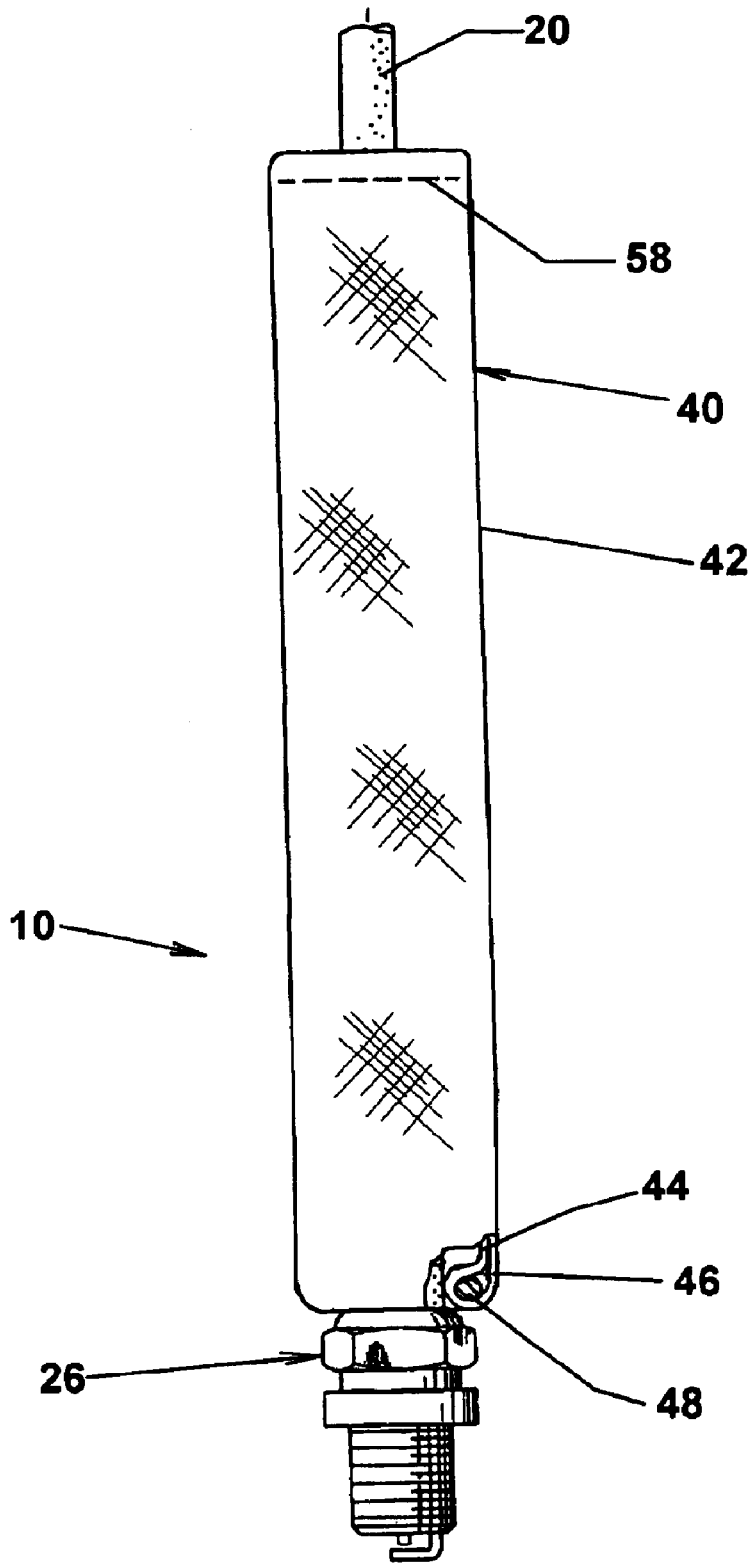
FIG. 2 is a side elevational view of the cover of FIG. 1 on the ignition line.

Referring to the drawings for the purpose of describing the preferred embodiments only and not for limiting same, FIGS. 1 and 2 show a charge dissipative cover 10 for the ignition line 12 for a combustion chamber 14 of an internal combustion engine 16. As conventional, the ignition line 12 includes an ignition cable 20 terminating with a socket terminal 22 attached to the stud terminal 24 of a spark plug 26. An elastomeric spark plug boot 28 is carried at an upper end on the ignition cable 20 and includes a lower skirt 30 having an interior socket engaging and sealing the spark plug insulator 32. The spark plug 26 is received in a recessed port 34 in the cylinder head 36 of the engine with a threaded shank 38 conventionally screwed into a threaded opening interfacing with the combustion chamber 14.

The ignition line components employed differ by engine, model and manufacturer. The cover as herein described finds application in the vast majority of engines designs for use as original or aftermarket equipment. The cover has sufficient flexibility for use with in-line as well as angular offset boots and cables.

The cover 10 overcomes the problems associated with high operating temperatures, high voltage, and static and corona charges. The cover 10 includes a tubular cover body 40 formed of a high temperature resistant braided fabric having a thermally insulating and electrically conductive coating system 42 on the outer surfaces thereof. The cover body 40 is preferably formed of braided fiberglass sleeving, preferably E-type glass. Suitable fabric is available as product no. 2F-120-18 from Atkins & Pearce, Inc. of Covington, Ky. A 1-inch inner diameter tube accommodates the majority of current ignition assembly configurations. Prior to assembly, the tubing is heat treated and annealed to remove resins and reduce fraying.

Figure 3:
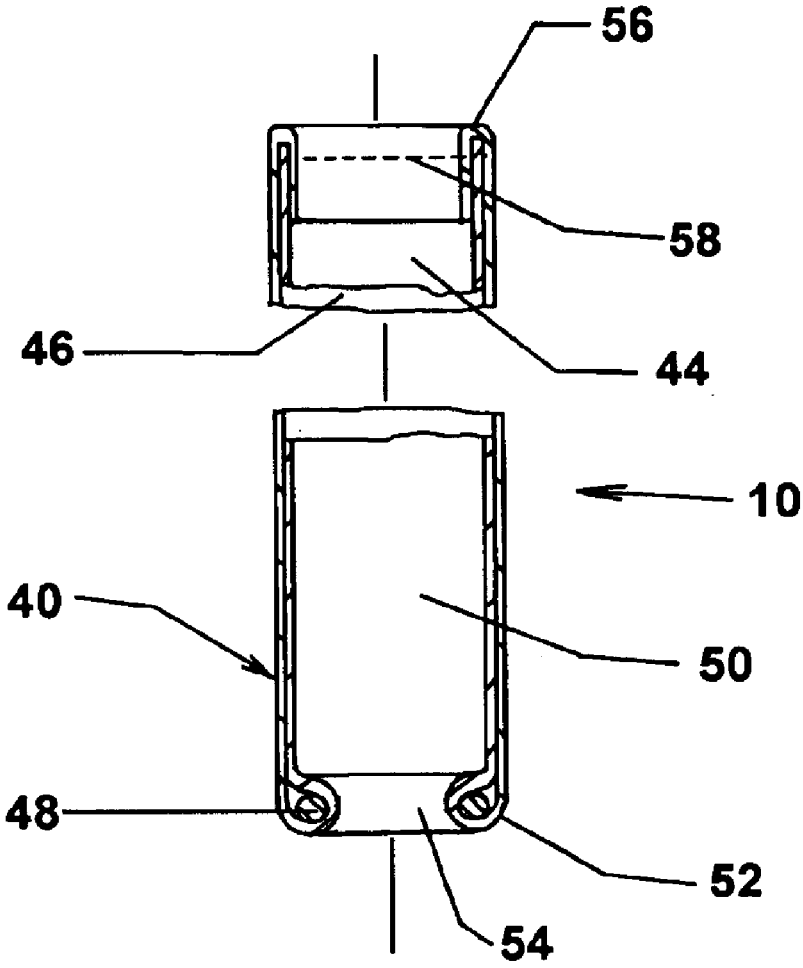
FIG. 3 is a sectioned side view of the cover of FIG. 1.

Referring to FIG. 3, the body 40 includes an inner layer 44 and an overlying outer layer 46 folded and gathered around a retaining ring 48 thereby defining a cylindrical upwardly opening socket 50 downwardly terminating with an inwardly curved annular mouth 52 having a coaxial circular port 54 establishing a sliding fit with the spark plug insulator 32. The upper end of the outer layer 46 is inwardly folded over the inner layer 44 at cylindrical hem 56. The upper ends of the layers and the hem 56 are interconnected at circumferential stitching 58.

Figure 4:
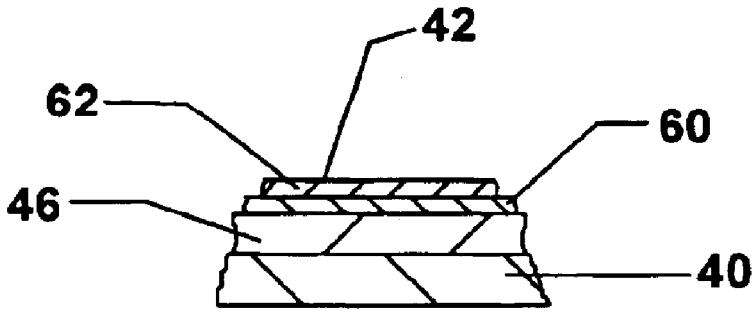
FIG. 4 is a fragmentary cross sectional view of the cover wall including the conductive base coat and dielectric top coat.

Referring to FIG. 4, the coating system 31 comprises an electrically conductive, heat reflective base coat 44 and a heat resistant, dielectric top coat 46. The base coat 44 comprises a sprayed silicone resin having a substantial portion of electrically conductive flake. The base coat 44 is characterized by a low breakdown voltage that functions to bleed static and corona charges under engine operating conditions. The base coat 44 is spray applied and ambiently dried to the touch without curing. Final curing takes place under engine operating conditions. Alternatively, the base coat 44 may be cured prior to use. The top coat 46 is spray coated over the dried base coat 44. The top coat 46 comprises a silicone resin containing an effective amount of high temperature ceramic material sufficient to provide infrared reflectivity and dielectric protection from external sources.

A suitable base coat formulation comprises a silicone component, in powder and/or liquid resin form, in a solvent and carrier base and containing an amount of metallic particulate, in flake or otherwise finely dispersible form, for providing the desired electrical characteristics in the base coat 44. Suitable catalysts and fillers may be added. The dried base coat contains about 15 to 35% metallic particulate based on weight, with 25 to 30% preferred. A preferred metallic particulate is aluminum flake having a particulate size of around 50 microns.

An effective formulation for the base coat is set forth below:

| Item | Vendor | Product No. | Amount (gr.) |
|---|---|---|---|
| Aluminum | | 552750 | 545 |
| Acetone | | | 1,135 |
| Xylene | | | 200 |
| Silicone Resin | | | |
| Powder | Seegott | SILREZ 604 | 1,360 |
| Liquid | Seegott | SY-409 | 130 |
| Talc | | | 27 |
| Catalyst | | | |
| Iron Hex | 6% | OMG | 7 |

The formula is prepared by mixing the acetone and xylene and gradually adding and dissolving the silicone powder. Thereafter the silicone liquid and aluminum flake are added and mixed thoroughly, the talc added and the catalyst slowly added and mixed. The mixture is blended sufficiently to avoid settling and transferred to a spray apparatus for application.

The top coat is based on the above formulation, with a suitable ceramic pigment substituted for the metallic particulate. For a red color, for example, a red ceramic pigment is used. A suitable pigment is available from General Color as product no. GR0660. Depending on the engine operating temperatures and proximity to the exhaust manifold, the ceramic content may be in the range of about 15% to 45% based on the weight of the silicone components.

The coating system 42 has been determined to provide both conductive and dielectric properties in covers using the above formulations. Covers containing only the base coat system have been tested in accordance with accepted protocols and were determined to have relatively low breakdown voltages of around 500 volts, well below that necessary for the effective grounding of the charges experienced in high voltage ignition systems. Covers containing the top coat withstood greater than 4,000 volts without any indications of breakdown, demonstrating substantial dielectric properties resisting outside interference.

Figure 5:
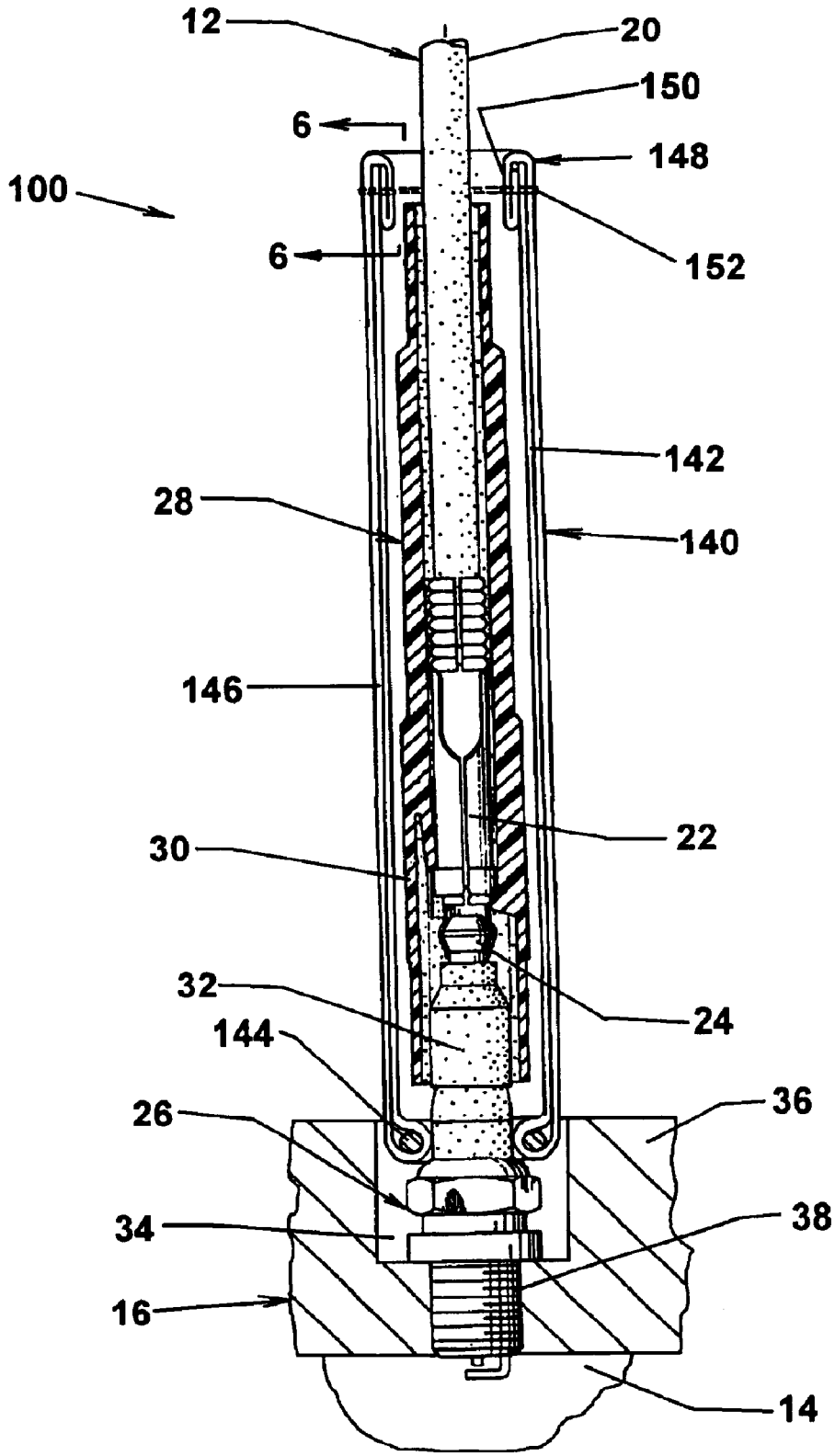
FIG. 5 is a side cross sectional view of a cover installed over an ignition line including an ignition cable, a spark plug boot and a spark plug according to another embodiment of the invention.
Figure 6:
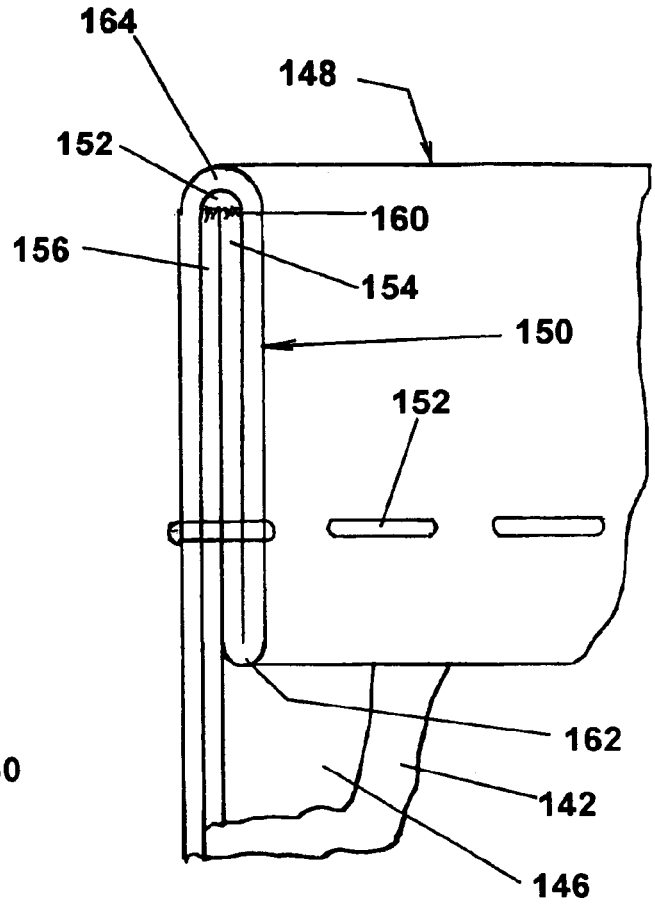
FIG. 6 is an enlarged fragmentary cross sectional view of the end cuff of the cover taken along line 6—6 in FIG. 5.
Figure 7:
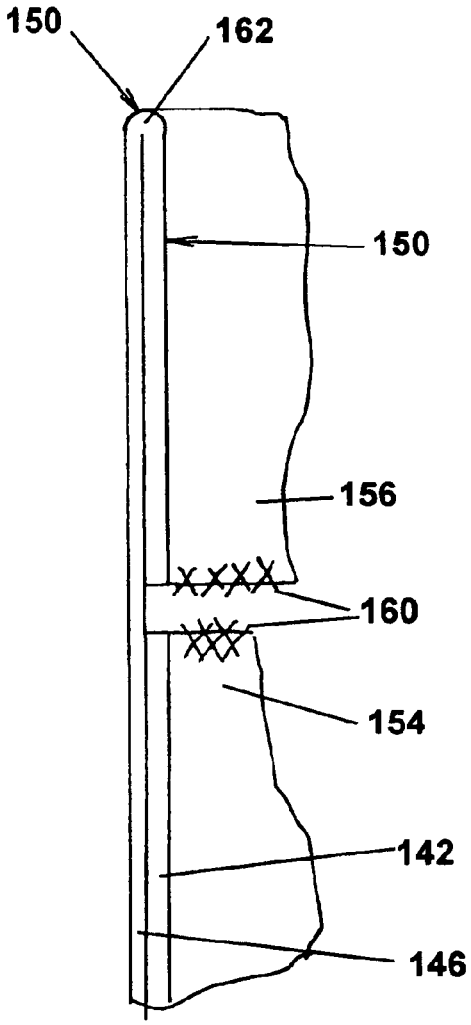
FIG. 7 is an enlarged fragmentary cross sectional view of the end of the cover of FIG. 5 prior to forming of the end cuff.

Referring to FIGS. 5 through 7 for the purpose of describing an additional embominent wherein the prior components are identified by like numerals, there is shown an improved wear and operation resistant cover 100 for the ignition line 12 for a combustion chamber 14 of an internal combustion engine 16. The ignition line 12 includes an ignition cable 20 terminating with a socket terminal 22 attached to the stud terminal 24 of a spark plug 26. An elastomeric spark plug boot 28 is carried at an upper end on the ignition cable 20 and includes a lower skirt 30 having an interior socket engaging and sealing the spark plug insulator 32. The spark plug 26 is received in a recessed port 34 in the cylinder head 36 of the engine with a threaded shank 38 conventionally screwed into a threaded opening interfacing with the combustion chamber 14.

The cover 100 includes a tubular cover body 140 formed of a high temperature resistant braided fabric. The cover body 140 is formed of a single length of fabric with cut ends. The cover body includes an inner layer or sleeve 142 extending from a free upper end conformally formed about an annular ring 144 and reversely formed to provide an outer layer or sleeve 146 overlying the inner sleeve and upwardly terminating with a circular entrance cuff 148 having an inwardly turned hemmed flap 150 that is circumferentially attached the sleeves 142, 146 by stitching 152. As shown in FIG. 6, the flap 150 and stitching 150 form annular enclosure 153 capturing the free ends 154, 156 of the inner sleeve 142 and the outer sleeve 146, respectively.

Referring to FIG. 7 illustrating the cover prior to formation of the cuff 148, the ends of the sleeves 144, 146 include frayed end strands 160. Such end strands are prone to further unraveling under engine operating conditions and through repeated installation and removal of the cover. To overcome this problem, after formation of the sleeves about the ring 144, the length of the outer sleeve 146 is sufficiently longer than the inner sleeve 142 thereby allowing the free end 156 to be reversely folded at hem 162 and conformed to the inner surface of the outer sleeve 146 thereby forming the flap 150. Thereafter the flap 150 is reversely folded at hem 164 and conformed to the inner surface of the inner sleeve 142. Thereafter the stitching is applied to form the enclosure 153 and capture the end strands 160.

In addition to enclosing the end strands to prevent unraveling and disintegration, the enlarged and strengthened end cuff 148 provides further performance and durability benefits. The hems 162 and 164 and the four ply cuff 148 increase the hoop strength of the entrance end of the cover 100 and maintains the circularity of the opening by resisting creasing, ovating and other non-circular distortions. This maintains an open air circulation annulus to reduce heat transfer to the ignition components. Further, the four ply cuff increase the unsupported mass at the end of the cover thereby reducing the harmonic vibrations at the sleeve that can lead to glass strand fracture.

As a result of the foregoing, the cover 100 has been found to extend the life span of the cover, maintain the structural and insulative properties under extreme operating conditions, and retain the aesthetic appearance notwithstanding active maintenance.

While the present embodiment has been described with reference to the preferred embodiments, other modifications and changes thereto will become apparent. Accordingly, the invention is to be interpreted solely with reference to the following claims.

What is claimed is:

1. A protective cover for the spark plug boot connected with an ignition wire and spark plug of an engine, comprising: a single length of woven glass tubular sleeve having an inner layer and an outer layer gathered at one end around a circular retainer ring and forming a restricted mouth with a lower opening wherein the end of said outer layer extends beyond the end of the inner layer and the end of the outer layer is reversely inwardly folded to form a flap having a circumferential hem, and wherein the flap is reversely inwardly folded overlying the end of the inner layer; and a circumferential stitching attaching the flap to said outer layer and said inner layer at an axial location intermediate the hem and said ends of said inner layer and said outer layer thereby forming a four layer circumferential cuff having an enclosure capturing said ends of said layers; and a coating system on said outer layer including a silicone-based base coat containing metallic particulate in sufficient quantity to make said base coat conductive for grounding static and corona charges in said ignition wire.

2. The cover as recited in claim 1 wherein said metallic particulate is aluminum flake.

3. The cover as recited in claim 2 wherein said aluminum flake has a particle size providing a low break down voltage in said base coat.

4. The cover as recited in claim 3 wherein said aluminum flake has a particle size of around 50 microns.

5. The cover as recited in claim 4 wherein said aluminum flake is about 15 to 35% by weight of said base coat.

6. The cover as recited in claim 5 wherein said aluminum flake is about 25 to 30% by weight of said base coat.

7. The cover as recited in claim 2 including a topcoat overlying said base coat and containing refractive particles providing dielectric and thermal resistance properties to said top coat dielectric.

8. The cover as recited in claim 7 wherein said refractive particles are ceramic pigments.

9. The cover as recited in claim 8 wherein said ceramic pigments provide a contrasting coloration to said base coat.

10. The cover as recited in claim 8 wherein said ceramic pigments provide infrared reflectivity to said top coat.

11. The cover as recited in claim 10 wherein said ceramic pigments comprise about 10 to 45% by weight of said top coat.

12. The cover as recited in claim 10 wherein said spark plus is carried in a recessed port in said engine and said mouth of said sleeve is smaller than said port for reception therein.

13. A method of making a protective cover for a spark plug boot comprising the steps of: providing a tubular member comprising a length of woven glass strands having a first end and a second end; providing a circular ring; locating said ring exterior of a center portion of said tubular member to define a first section including said first end and a second section including said second end; inverting the first section over said ring and said second section with said first end extending beyond said second end; inverting said first end into first section adjacent said second end thereby forming a flap section; inverting said flap section into said second section; and connecting said flap section to said first and second section with circumferential stitching at a location removed from said first and second ends thereby forming an enclosed pocket in which said ends are captured.

14. The method as recited in claim 13 including the step of applying a coating system on said outer layer including a silicone-based base coat containing metallic particulate in sufficient quantity to make said base coat conductive for grounding static and corona charges in said ignition wire.

* * * * *